US006831567B2

(12) United States Patent
Liao

(10) Patent No.: US 6,831,567 B2
(45) Date of Patent: Dec. 14, 2004

(54) CLAMPING DEVICE HAVING LOSS-GUARD FUNCTION

(76) Inventor: Sheng Hsin Liao, No. 10, Alley 38, Lane 229, San Chun Ct, Shulin City, Taipei Hsien (TW)

( * ) Notice: Subject to any disclaimer, the term of this patent is extended or adjusted under 35 U.S.C. 154(b) by 63 days.

(21) Appl. No.: 10/270,573

(22) Filed: Oct. 16, 2002

(65) Prior Publication Data

US 2004/0077390 A1 Apr. 22, 2004

(51) Int. Cl.[7] ..... G08B 21/00

(52) U.S. Cl. ..... 340/686.1; 340/568.1; 340/571; 340/568.7

(58) Field of Search ..... 340/686.1, 568.1, 340/571, 686.6, 693.9, 539.11, 568.7, 572.8

(56) References Cited

U.S. PATENT DOCUMENTS 5,402,104 A * 3/1995 LaRosa ..... 340/539.23
5,629,677 A * 5/1997 Staino, Jr. ..... 340/568.1
6,140,923 A * 10/2000 Lam ..... 340/568.7
6,154,665 A * 11/2000 Briffett et al. ..... 455/574
6,538,571 B1 * 3/2003 Huang ..... 340/568.1
6,577,239 B2 * 6/2003 Jespersen ..... 340/572.1
6,593,851 B1 * 7/2003 Bornstein ..... 340/539.15

* cited by examiner

*Primary Examiner*—John Tweel
(74) *Attorney, Agent, or Firm*—Apex Juris, pllc; Tracy M. Heims

(57) ABSTRACT

A clamping device having loss-guard function includes a shell body, a circuit unit, and a connection component. The shell body has a receiving space therein. A clamping sheet is disposed on the outer wall of the shell body. The circuit unit is disposed in the receiving space, and can receive signals emitted by an emission component disposed on a portable electronic device. The circuit unit has alarming components. The connection component is connected on the portable electronic device. The connection component also is connected with the shell body in a detachable way. The clamping device can clamp the portable electronic device onto a users waistband. When the portable electronic device is away from the circuit unit a certain distance, the circuit unit will be immediately driven to give out alarming lights or sounds, thereby preventing the portable electronic device from being lost or stolen by thieves.

12 Claims, 12 Drawing Sheets

CLAMPING DEVICE HAVING LOSS-GUARD FUNCTION

FIELD OF THE INVENTION

"The present invention relates to a clamping device having a loss-guard function and, more particularly, to a clamping device which can be clamped on a user's waistband to facilitate carrying of a portable electronic device, and can effectively prevent the portable electronic device from being lost."

BACKGROUND OF THE INVENTION

Along with continual progress of the information technology, portable electronic devices like mobile phones, personal digital assistants (PDAs), and electronic communications products have become articles frequently used in everyday lives of most people. Generally, a portable electronic device can be clamped onto a user's waistband by using a sheath to facilitate carrying. However, this way of carrying a portable electronic device may easily cause the situation that the portable electronic device is lost or stolen by thieves.

Accordingly, the above conventional portable electronic device has drawbacks and inconvenience in practical use. The present invention aims to resolve the problems in the prior art.

SUMMARY OF THE INVENTION

The primary object of the present invention is to provide a clamping device having loss-guard function, whereby a portable electronic device can be clamped on a user's waistband. When the portable electronic device is away from a circuit unit of the clamping device a certain distance, the circuit unit will be immediately driven to give out alarming lights or sounds, hence effectively preventing the portable electronic device from being lost or stolen by thieves.

To achieve the above object, the present invention provides a clamping device having loss-guard function, which can be connected with a portable electronic device having a preset emission component. The clamping device comprises a shell body, a circuit unit, and a connection component. The shell body has a receiving space therein. A clamping sheet is disposed on the outer wall of the shell body. The circuit unit is disposed in the receiving space, and can receive signals emitted by the emission component disposed on the portable electronic device. The circuit unit has alarming components. The connection component is connected on the portable electronic device. The connection component is also connected with the shell body in detachable way.

The various objects and advantages of the present invention will be more readily understood from the following detailed description when read in conjunction with the appended drawing, in which:

DETAILED DESCRIPTION OF THE PREFERRED EMBODIMENTS

Figure 1:
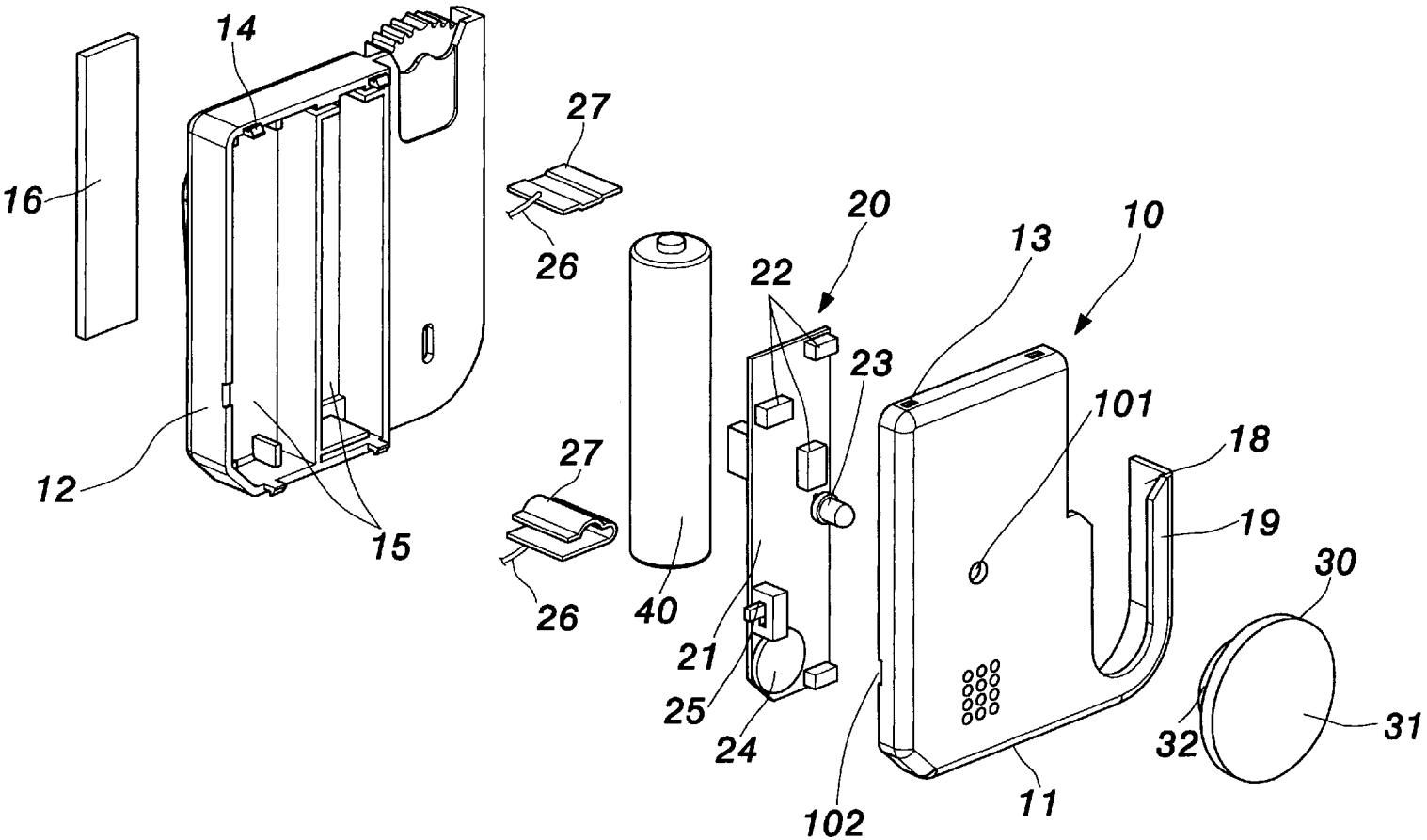
FIG. 1 is an exploded perspective view of a first embodiment of the present invention.
Figure 2:
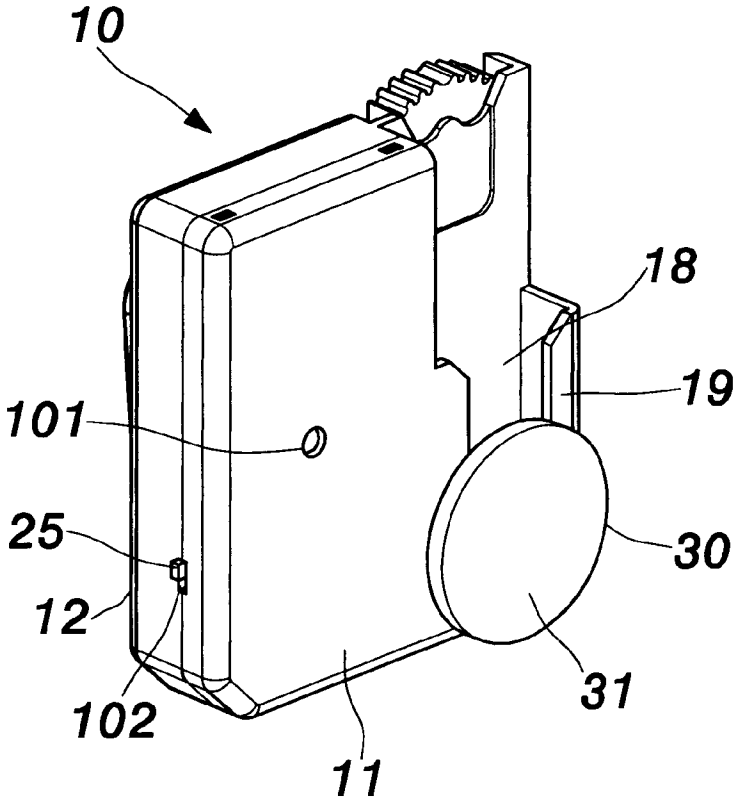
FIG. 2 is a perspective assembly view of the first embodiment of the present invention.
Figure 3:
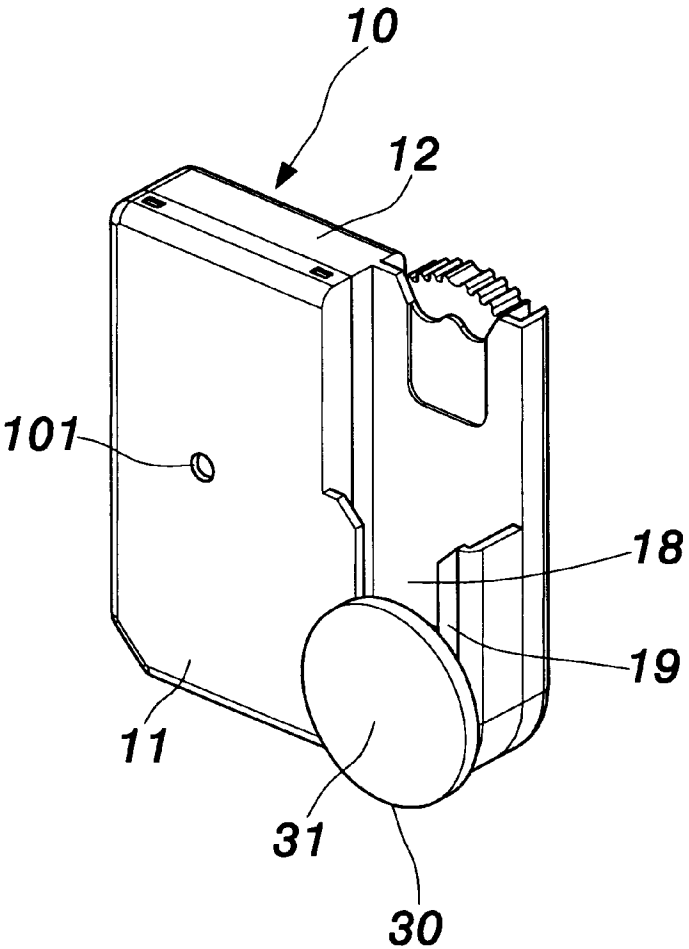
FIG. 3 is another perspective assembly view of the first embodiment of the present invention.
Figure 4:
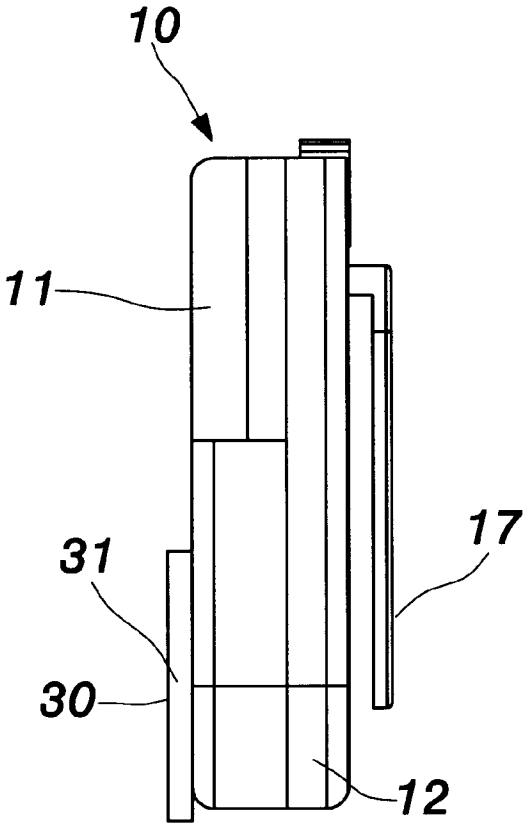
FIG. 4 is a side view of the first embodiment of the present invention.
Figure 5:
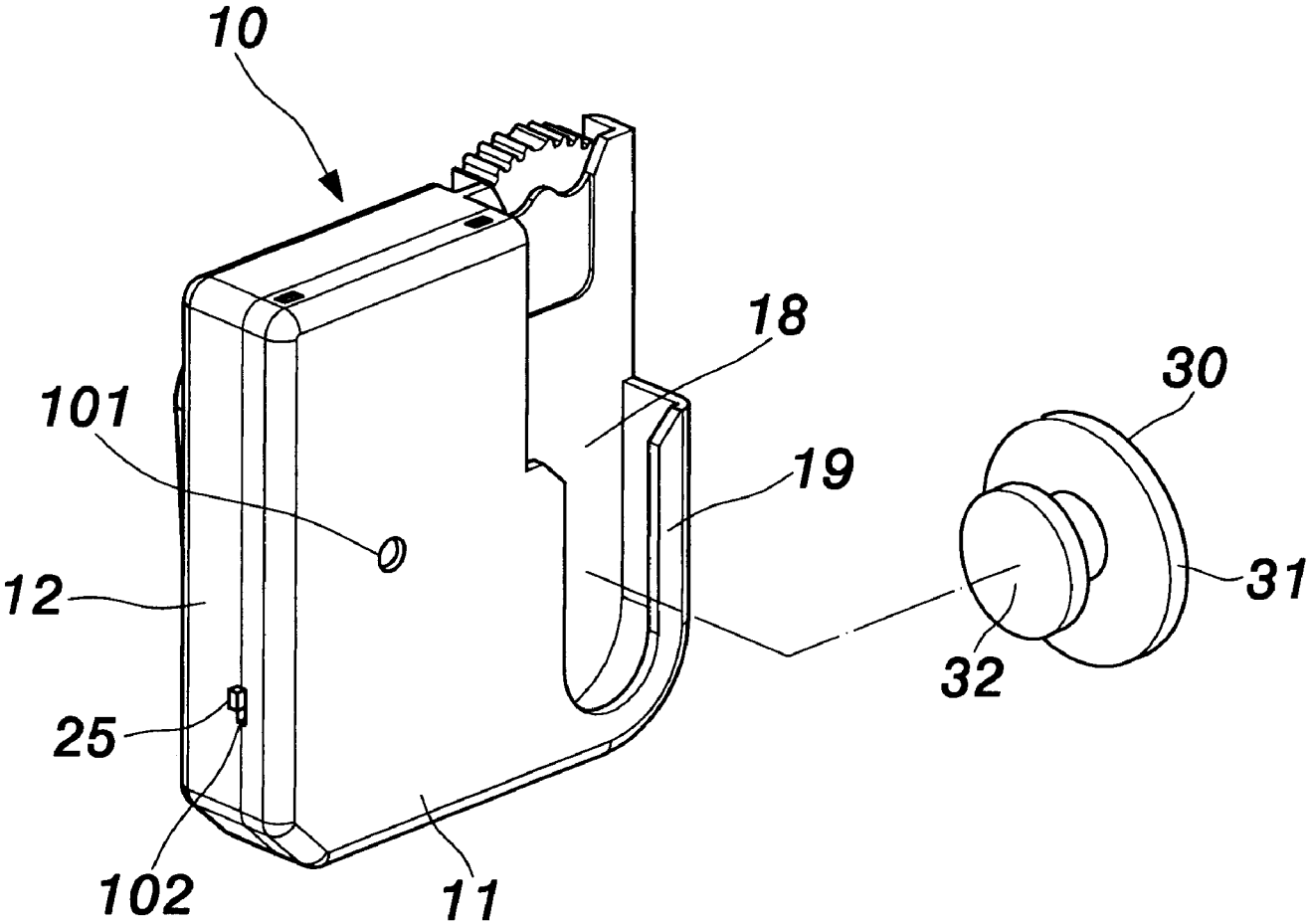
FIG. 5 is a perspective assembly view showing a separate state of the connection component of the first embodiment of the present invention.

As shown in FIGS. 1 to 5, the present invention provides a clamping device having loss-guard function. The clamping device comprises a shell body 10, a circuit unit 20, and a connection component 30. The shell body 10 is composed of a first half shell 11 and a second half shell 12, which are assembled together by means of fastening, locking with screws, or supersonic welding. In this embodiment, the first half shell 11 and the second half shell 12 are assembled together by means of fastening. Speaking more clearly, corresponding fastening holes 13 and fastening hooks 14 are disposed on the first half shell 11 and the second half shell 12. Through mutual fastening of the fastening holes 13 and the fastening hooks 14, the first half shell 11 and the second half shell 12 are assembled together.

The shell body 10 has a receiving space 15 therein for receiving components like the circuit unit 20 and a battery 40. A battery cover corresponding to the battery 40 is fastened at the rear side of the shell body 10. The battery cover 16 can be detached to facilitate replacement of the battery 40. A clamping sheet 17 is disposed on the outer wall of the rear side of the shell body 10, and can be used to clamp the clamping device of the present invention on a user's waistband. A fastening groove 18 is disposed at the front side of the shell body 10. The fastening groove 18 is a U-shaped groove body having an open upper end. A baffle 19 is extended from the front side of the fastening groove 18.

Figure 6:
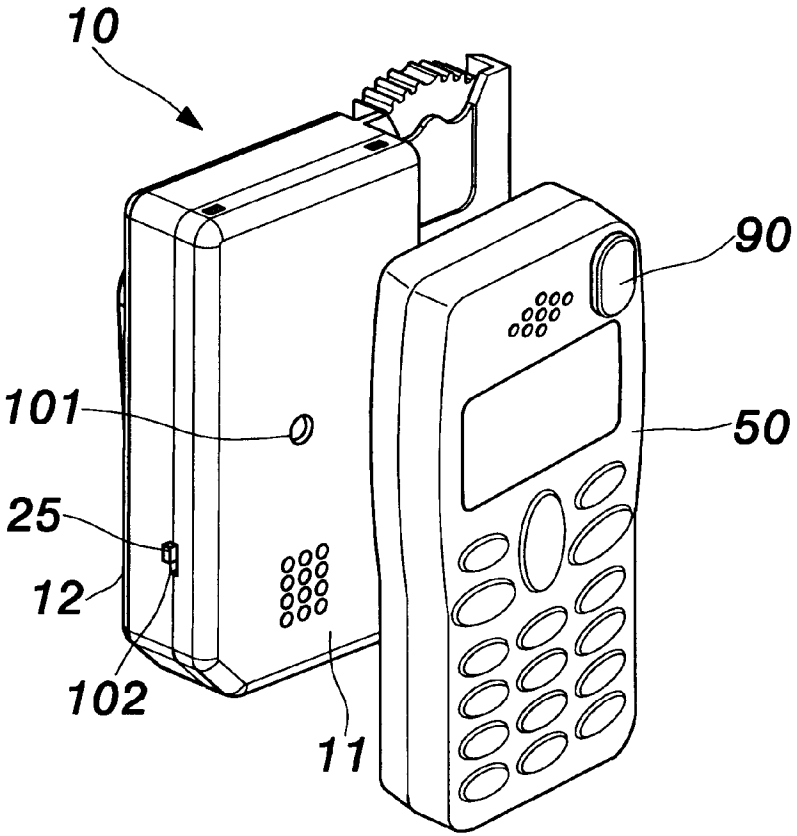
FIG. 6 is a diagram showing the use state of the first embodiment of the present invention.
Figure 9:
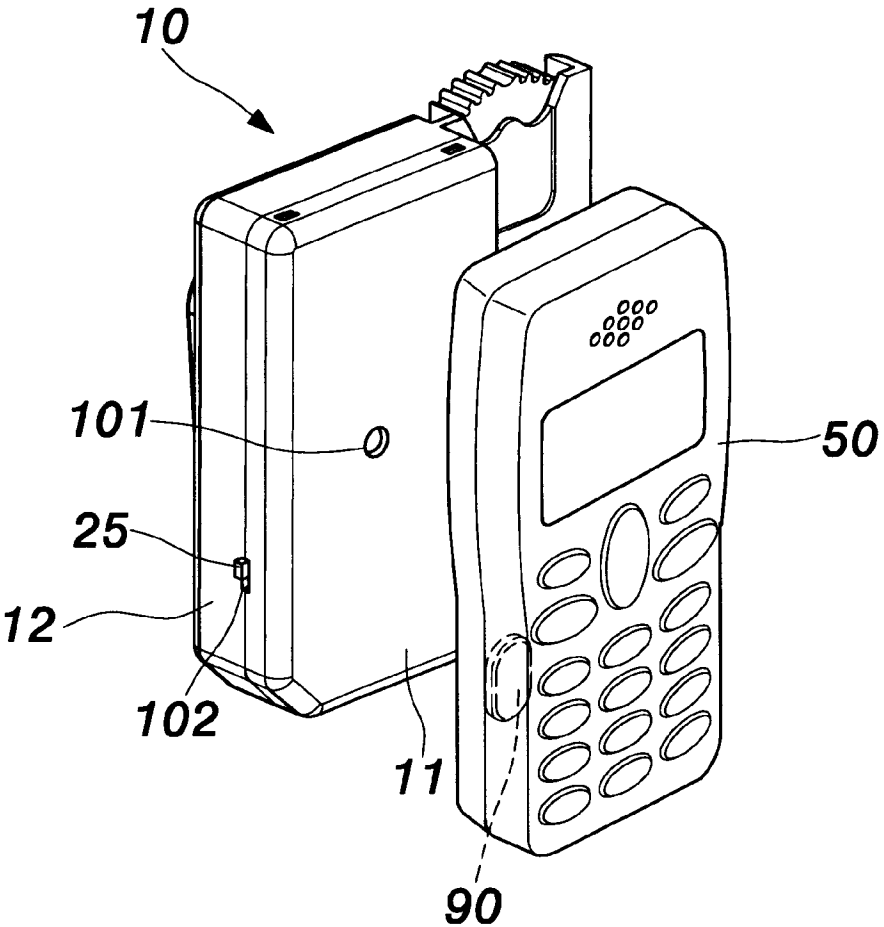
FIG. 9 is still yet another diagram showing the use state of the first embodiment of the present invention.

The circuit unit 20 is composed of a circuit board 21 and several electronic components 22. The circuit unit 20 is disposed in the receiving space 15. The electronic components 22 have the function of a reception component, and can be used to receive signals emitted by an emission component 90 (shown in FIGS. 6 and 9) preset on a portable electronic device. The emission component 90 can be fixed on the outside of a portable electronic device like a mobile phone 50 by adhering with glue (FIG. 6), or can be fixed in a portable electronic device like the mobile phone 50 in a built in way (FIG. 9).

The circuit board 21 has alarming components (e.g., a light-emitting component 23 and a sounding component 24) and a switch 25. The light-emitting component 23 is a device like a light-emitting diode (LED). The sounding component 24 is a device like a buzzer. The switch 25 can be used to switch or turn off the circuit unit 20 according to necessity. A light-transmission hole 101 corresponding to the light-emitting component 23 and a switch hole 102 corresponding to the switch 25 are disposed on the shell body 10 to let the light-emitting component 23 and the switch 25 be properly exposed.

The circuit board 21 is connected to two conducting sheets 27 with conducting wires 26. The two conducting sheets 27 are properly fastened in the receiving space 15 of the shell body 10, and can respectively contact two poles of the battery 40. The battery 40 and the circuit unit 20 can thus be properly connected so that the electricity of the battery 40 can be transmitted to the circuit unit 20.

Figure 7:
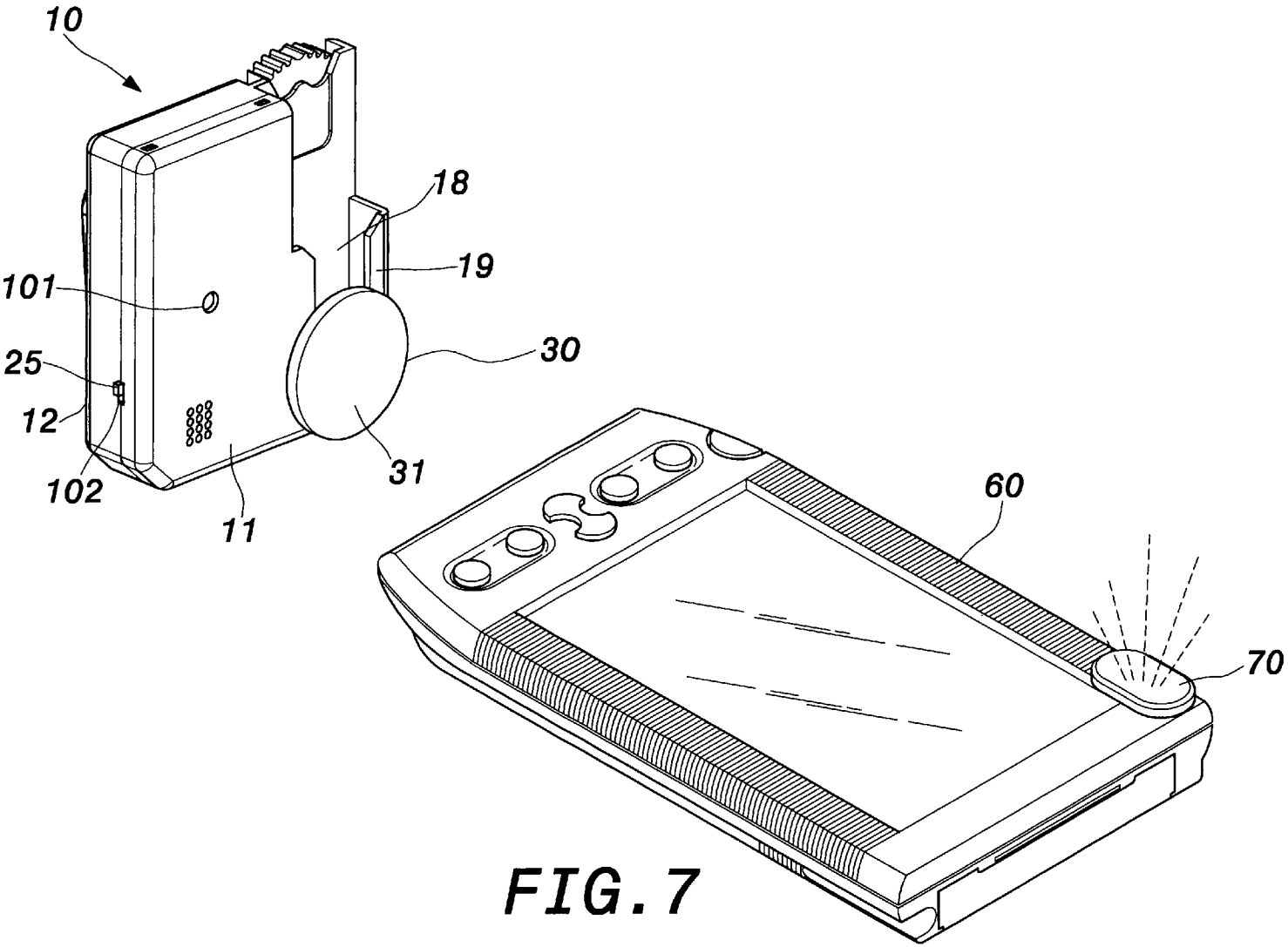
FIG. 7 is another diagram showing the use state of the first embodiment of the present invention.
Figure 8:
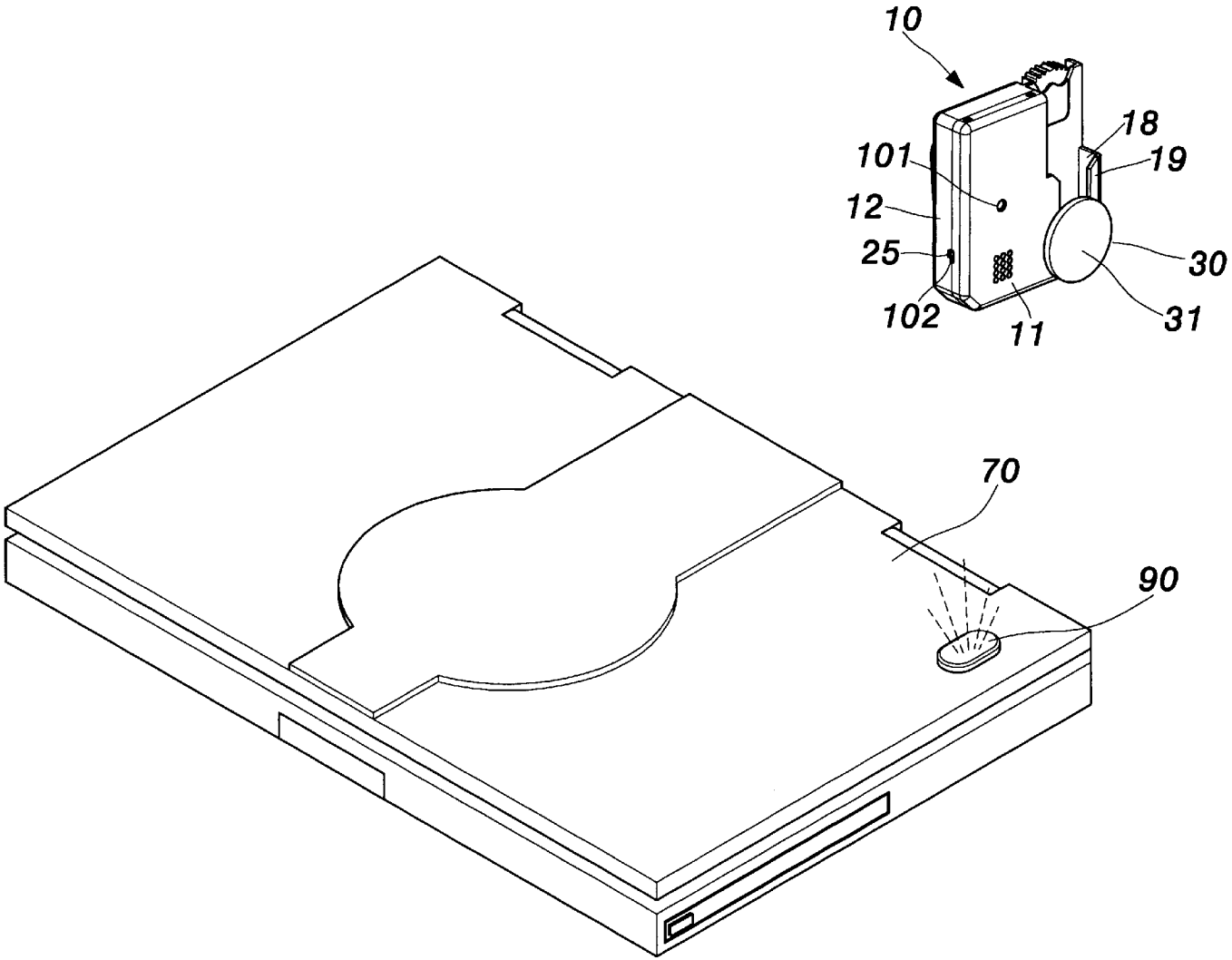
FIG. 8 is yet another diagram showing the use state of the first embodiment of the present invention.

The connection component 30 has a connection portion 31 and a fastening portion 32. One face of the connection portion 31 can be connected with a portable electronic device like the mobile phone 50 (FIG. 6), a personal digital assistant 60 (FIG. 7), or another electronic communications product 70 (FIG. 8) so that the connection component 30 can be fixed on the portable electronic device. The fastening portion 32 is extended from the other face of the connection portion 31. The fastening portion 32 is a T-shaped post body, and is fastened with the fastening groove 18 of the shell body 10 in detachable way. The baffle 19 at the front side of the fastening groove 18 is used to prevent the fastening portion 32 from going forwards out of the fastening grove 18. Thereby, the connection portion 30 can connect the portable electronic device onto the shell body 10. The clamping device having loss-guard function of the present invention is thus formed.

"The emission component 90 preset on a portable electronic device like the mobile phone 50 (FIGS. 6 and 9), the personal digital assistant (PDA) 60 (FIG. 7), or the electronic communications product 70 (FIG. 8) can emit signals, which are received by the circuit unit 20 of the clamping device. However, when the portable electronic device is away from the circuit unit 20 of the clamping device a certain distance, the circuit unit 20 can no longer receive signals emitted by the emission component 90 on the portable electronic device. The alarming components like the light-emitting component 23 and the sounding component 24 will be immediately driven to give off light or sound, thereby effectively preventing the portable electronic device from being lost or stolen by thieves."

Figure 10:
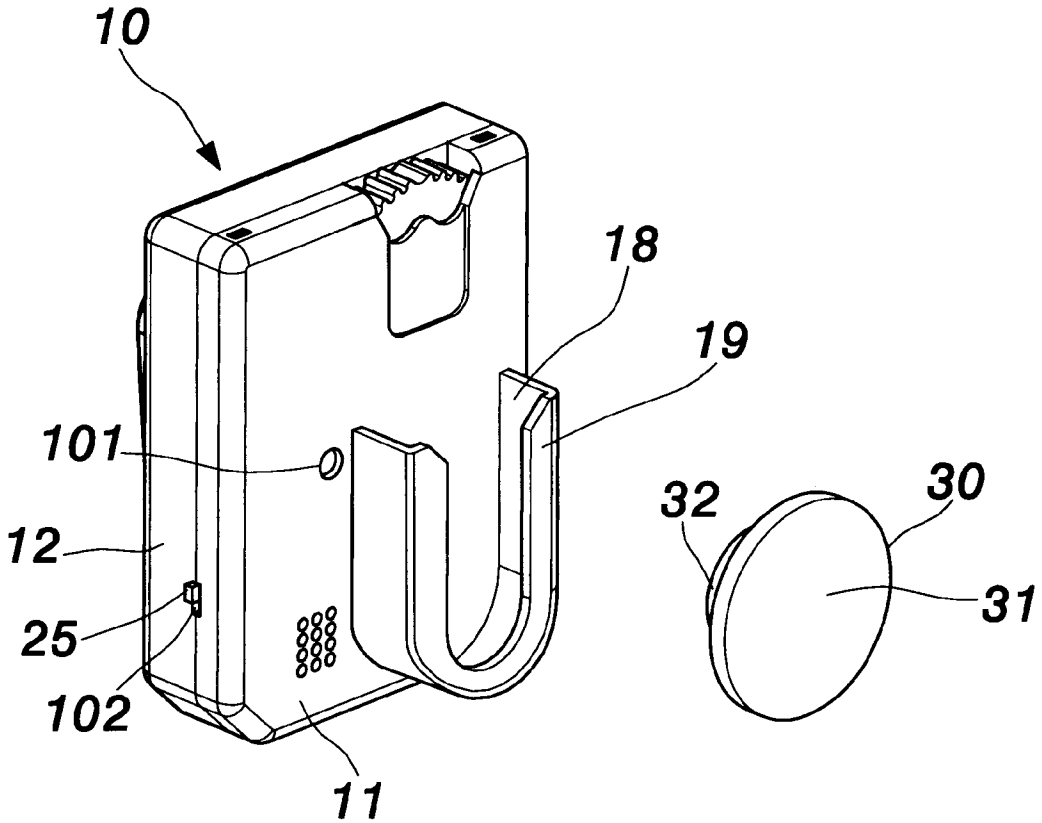
FIG. 10 is a perspective assembly view of a second embodiment of the present invention.

Besides, as shown in FIG. 10, it is also feasible that the fastening groove 18 and baffle 19 of the present invention protrude out of the front side of the shell body 10.

Figure 11:
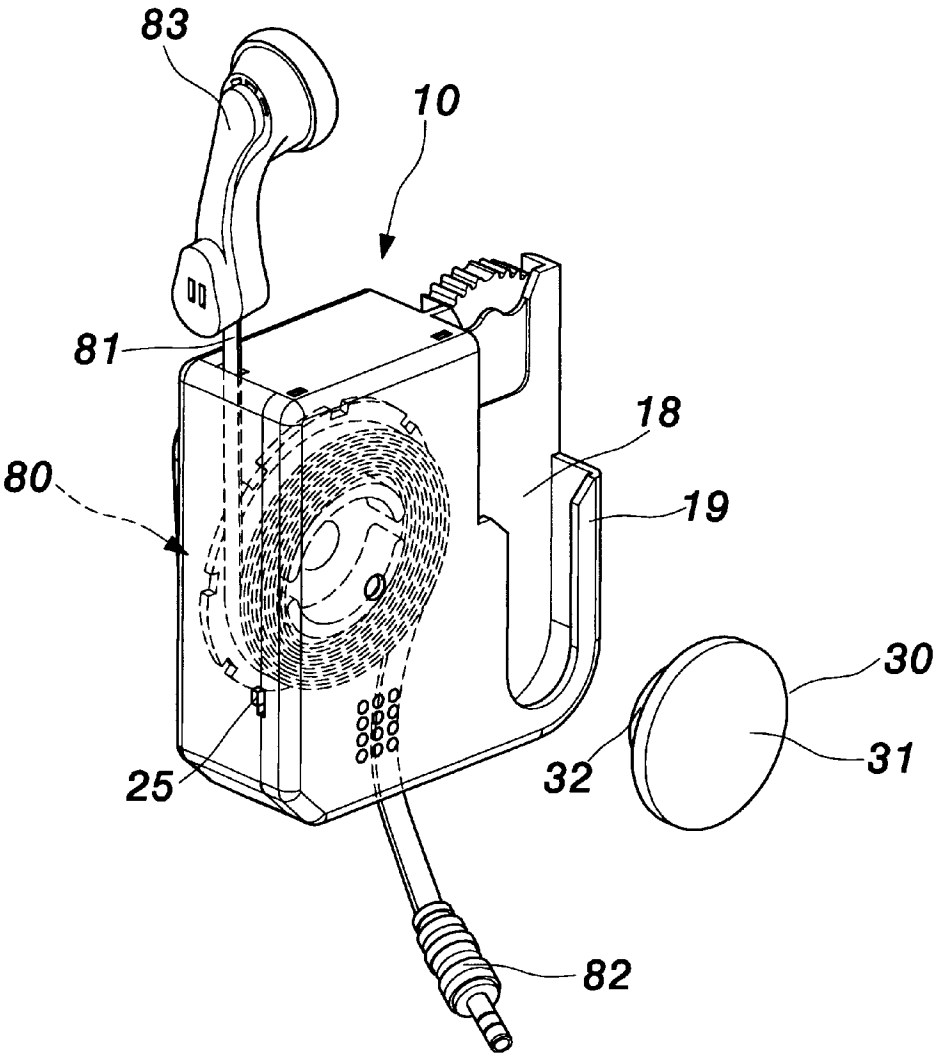
FIG. 11 is a perspective assembly view of a third embodiment of the present invention.

Additionally, as shown in FIG. 11, a wire-winding unit 80 can also be disposed in the shell body 10 so that a signal cable 81 can be selectively wound into the shell body 10 or pulled out of the shell body 10. The length of the signal cable 81 can be momentarily adjusted according to necessity so that entanglement of cable due to a too-long length of external cable or inconvenience of use due to a too-short length of external cable will not arise. Moreover, the two ends of the signal cable 81 can connect a plug 82 and an earphone 83 or a hand-free headset, respectively. The plug 82 can be plugged into the portable electronic device so that the earphone 83 can be used to hear sounds given out by the portable electronic device, or the hand-free headset can be used to transmit or receive voices.

Figure 12:
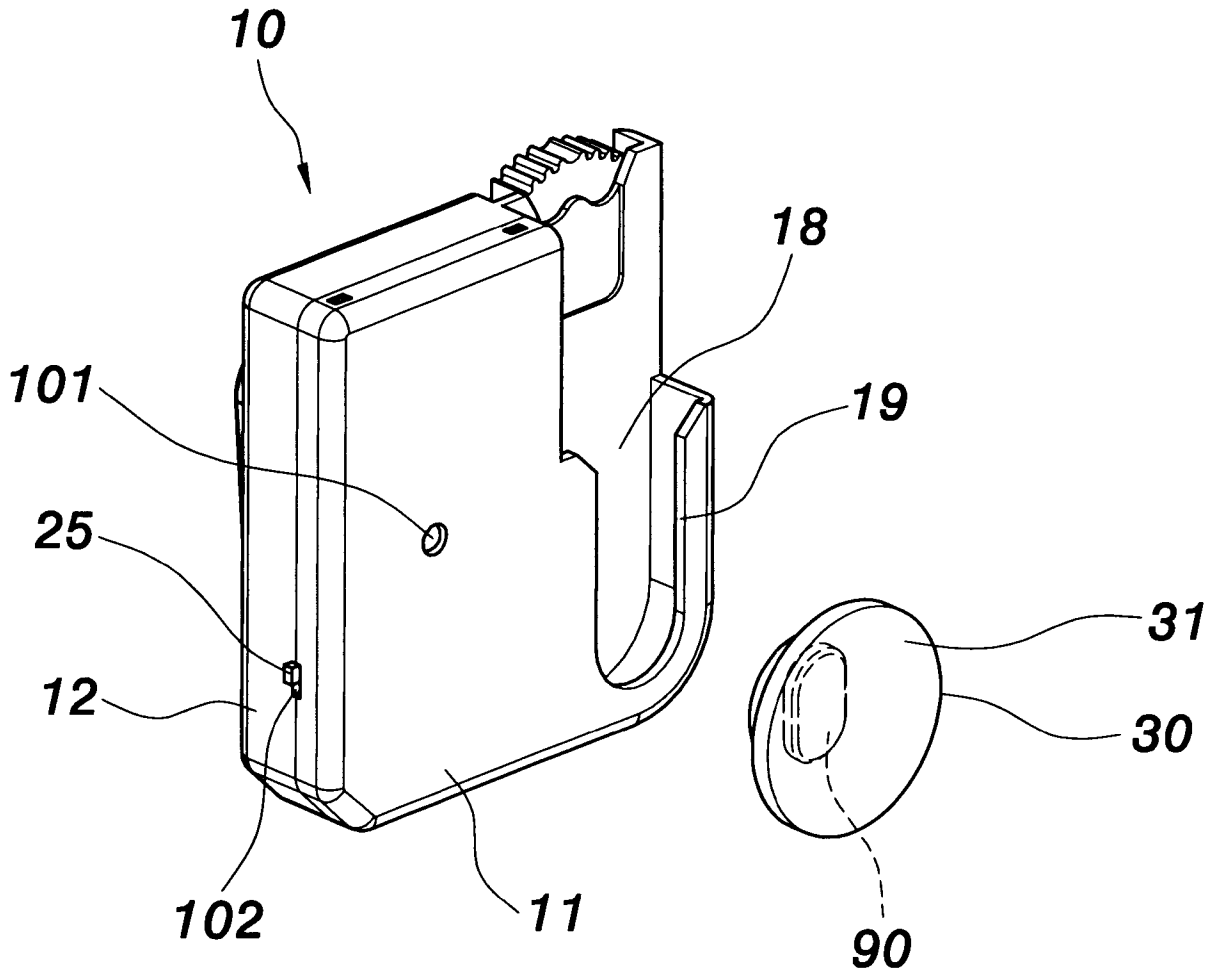
FIG. 12 is a perspective assembly view of a fourth embodiment of the present invention.

Also, as shown in FIG. 12, it is also feasible that the emission component 90 is installed in the connection component 30.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A clamping device with a loss-guard function and used to connect a portable electronic device having a preset emission component, said clamping device comprising:

a shell body having a receiving space formed therein, a clamping sheet being disposed on an outer wall of said shell body;

a circuit unit disposed in said shell body and capable of receiving signals emitted by said emission component on said portable electronic device, said circuit unit having an alarming component; and a connection component connected on said portable electronic device, said connection component being also connected on said shell body in a detachable way.

2. The clamping device having loss-guard function as claimed in claim 1, wherein said shell body has a first half shell and a second half shell assembled with said first half shell together.

3. The clamping device having loss-guard function as claimed in claim 1, wherein a battery is received in said receiving space of said shell body, said battery is connected with said circuit unit, and a battery cover corresponding to said battery is fastened at one side of said shell body.

4. The clamping device having loss-guard function as claimed in claim 1, wherein a fastening groove is disposed at a front side of said shell body, a baffle is extended from a front side of said fastening groove, and said connection component has a fastening portion fastened with said fastening groove at the front side of said shell body in detachable way.

5. The clamping device having loss-guard function as claimed in claim 1, wherein said alarming component of said circuit unit is a light-emitting component, and a light-transmission hole corresponding to said light-emitting component is disposed on said shell body.

6. The clamping device having loss-guard function as claimed in claim 1, wherein said alarming component of said circuit unit is a sounding component.

7. The clamping device having loss-guard function as claimed in claim 1, wherein said circuit unit has a switch, and a switch hole corresponding to said switch is disposed on said shell body.

8. The clamping device having loss-guard function as claimed in claim 1, wherein said connection component has a connection portion, and said connection portion is connected on said portable electronic device.

9. The clamping device having loss-guard function as claimed in claim 1, wherein a wire-winding unit is disposed in said shell body, a signal cable is elastically wound in said wire-winding unit, a plug and an earphone are respectively connected with two ends of said signal cable.

10. The clamping device having loss-guard function as claimed in claim 1, wherein a wire-winding unit is disposed in said shell body, a signal cable is elastically wound in said wire-winding unit, and a plug and a hand-free headset are respectively connected with two ends of said signal cable.

11. A clamping device having loss-guard function and used to connect a portable electronic device, said clamping device comprising:

a shell body, a clamping sheet being disposed on an outer wall of said shell body;

a connection component having an inbuilt emission component, said connection component being connected on said portable electronic device, said connection component being also connected with said shell body in detachable way; and a circuit unit disposed in said shell body and capable of receiving signals emitted by said emission component, said circuit unit having an alarming component.

12. A clamping device having loss-guard function and used to connect a portable electronic device having a preset emission component, said clamping device comprising:

a shell body, a clamping sheet being disposed on an outer wall of said shell body;

a circuit unit disposed in said shell body and capable of receiving signals emitted by said emission component disposed on said portable electronic device, said circuit unit having an alarming component; and a connection component connected on said portable electronic device, said connection component being also connected with said shell body in detachable way.

* * * * *